US008993503B2

(12) United States Patent
Keuleers et al.

(10) Patent No.: US 8,993,503 B2
(45) Date of Patent: Mar. 31, 2015

(54) THICKENED HAND DISHWASHING DETERGENT COMPRISING AN ALKOXYLATED ANIONIC SURFACTANT

(71) Applicant: The Procter & Gamble Company, Cincinnati, OH (US)

(72) Inventors: Robby Renilde Francois Keuleers, Lippelo (BE); Kelly Paula August Merckx, Welle (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/156,557

(22) Filed: Jan. 16, 2014

(65) Prior Publication Data

US 2014/0206592 A1 Jul. 24, 2014

(30) Foreign Application Priority Data

Jan. 21, 2013 (EP) ..... 13152043

(51) Int. Cl.

| | |
|---|---|
| ***C11D 1/29*** | (2006.01) |
| ***C11D 1/75*** | (2006.01) |
| ***C11D 1/83*** | (2006.01) |
| ***C11D 7/10*** | (2006.01) |
| ***C11D 9/10*** | (2006.01) |
| ***C11D 1/14*** | (2006.01) |
| ***C11D 1/94*** | (2006.01) |
| ***C11D 3/04*** | (2006.01) |
| ***C11D 17/00*** | (2006.01) |

(52) U.S. Cl.

CPC .. *C11D 1/14* (2013.01); *C11D 1/29* (2013.01); *C11D 1/83* (2013.01); *C11D 1/94* (2013.01); *C11D 3/046* (2013.01); *C11D 17/0026* (2013.01); *C11D 1/75* (2013.01)

USPC ..... 510/237

(58) Field of Classification Search

CPC ..... C11D 1/29; C11D 1/75; C11D 1/83; C11D 3/2006; C11D 7/10; C11D 9/10

See application file for complete search history.

(56) References Cited

U.S. PATENT DOCUMENTS

| | | | | |
|---|---|---|---|---|
| 6,069,122 | A * | 5/2000 | Vinson et al. | 510/235 |
| 6,172,021 | B1 * | 1/2001 | Ofosu-Asante et al. | 510/237 |
| 2002/0039988 | A1 * | 4/2002 | Kasturi et al. | 510/461 |
| 2003/0100464 | A1 * | 5/2003 | Kott et al. | 510/357 |
| 2011/0171155 | A1 * | 7/2011 | Federle et al. | 424/70.24 |
| 2013/0072417 | A1 * | 3/2013 | Perez-Prat Vinuesa et al. | 510/236 |
| 2014/0080748 | A1 * | 3/2014 | Price et al. | 510/228 |
| 2014/0148375 | A1 * | 5/2014 | Urbin et al. | 510/489 |

FOREIGN PATENT DOCUMENTS

| | | | |
|---|---|---|---|
| EP | 2 338 961 | A1 | 6/2011 |
| WO | WO 97/39089 | A1 | 10/1997 |
| WO | WO 98/56497 | A1 | 12/1998 |
| WO | WO 99/05082 | A1 | 2/1999 |
| WO | WO 99/05084 | A1 | 2/1999 |
| WO | WO 99/05241 | A1 | 2/1999 |
| WO | WO 99/05242 | A1 | 2/1999 |
| WO | WO 99/05243 | A1 | 2/1999 |
| WO | WO 99/05244 | A1 | 2/1999 |
| WO | WO 99/07656 | A2 | 2/1999 |
| WO | WO 00/23548 | A1 | 4/2000 |
| WO | WO 00/23549 | A1 | 4/2000 |

OTHER PUBLICATIONS

U.S. Appl. No. 14/156,534, filed Jan. 16, 2014, Keuleers, et al.
U.S. Appl. No. 14/156,550, filed Jan. 16, 2014, Keuleers, et al.
EPO Search Report; Application No. 13152043.9-1357; Dated Jan. 7, 2013; 6 Pages.

* cited by examiner

*Primary Examiner* — Charles Boyer
(74) *Attorney, Agent, or Firm* — Amy Ahn-Roll

(57) ABSTRACT

A liquid detergent comprising from about 5% to about 20% by weight thereof of a surfactant system wherein the surfactant system comprises an alkoxylated anionic surfactant having and alkoxylation degree of from 0.20 to 1.75 and wherein the detergent at 20° C. has a pouring viscosity of from about 2500 mPa s to about 6000 mPa s and a ratio of medium to high shear viscosity of from about 2 to about 1.

12 Claims, No Drawings

THICKENED HAND DISHWASHING DETERGENT COMPRISING AN ALKOXYLATED ANIONIC SURFACTANT

FIELD OF THE INVENTION

The present invention is in the field of detergents. In particular, it relates to a liquid detergent, more in particular to a liquid detergent having a low level of surfactant and a specific rheology. The detergent provides good cleaning, fast dissolution, has a favourable rheology and suds profile and is stable upon storage and shipping even under stressed conditions.

BACKGROUND OF THE INVENTION

The detergent formulator is continuously trying to improve detergent's performance, in terms of cleaning, dissolution, appearance, stability, environmental profile, cost effectiveness, easiness of manufacture, etc.

For some detergent users a thick liquid, i.e., a viscous liquid, connotes high quality, especially when the liquid maintains its thickness during pouring. Relatively high viscous liquids give a detergent the appearance of a thick, strong, effective product as opposed to a thin, weak, watery one. However a dichotomy exist, thicker liquids can have associated dissolution problems, negatively impacting on the performance of the detergent.

Detergent users usually associate high suds with cleaning. Thus a detergent should generate in use high and long lasting suds. The impact of the detergent in the environment is something that the formulator is always trying to reduce.

The objective of the present invention is to come up with an efficient cleaning detergent, with a good dissolution and suds profile, appealing rheology, good environmental profile, cost effective, easy to manufacture and which is stable upon storage.

SUMMARY OF THE INVENTION

According to the first aspect of the invention there is provided a liquid detergent, preferably a hand dishwashing liquid detergent. The detergent has low level of surfactant and provides good cleaning. The detergent comprises from about 5% to about 20%, preferably from about 8% to about 18% by weight thereof of a surfactant system. This low level of surfactant system contributes to a good environmental profile. The surfactant system comprises an alkoxylated anionic surfactant having and alkoxylation degree of at least about 0.2, more preferably at least 0.3 and specially at least 0.4. The alkoxylation degree is less than about 1.75, more the alkoxylation degree is from about 0.3 to about 1.60, even more preferably from about 0.4 to about 1.5 and especially from about 0.4 to about 1.0. Higher alkoxylation degree further contributes to better dissolution. It also contributes to the stability of the detergent at low temperature.

The viscosity of the detergent of the invention at rest and under normal pouring conditions is fairly constant. The liquid detergent does have a viscous consistence that as indicated above, users seem to associate to high quality.

The detergent of the invention has a pouring viscosity of from about 2500 mPa s to about 6000 mPa s, preferably from about 3000 mPa s to about 5000 mPa s as measured at 20° C. using a Brookfield DV-II+ Pro viscometer with spindle 31, at 0.6 rpm. Detergents having this pouring viscosity seem to be quite appealing to users. The ratio of medium shear to high shear viscosity is preferably, from about 2 to about 1, more preferably from about 1.5 to about 1, even more preferably from about 1.25 to about 1, most preferably about 1, this means that the viscosity of the detergent is fairly constant when exposed to different shear conditions, for example under transport and handling at high shear conditions. Preferably, the ratio of low shear to high shear viscosity is also from about 2 to about 1 more preferably from about 1.5 to about 1, even more preferably from about 1.25 to about 1, most preferably about 1.

As used herein low shear viscosity is meant as the viscosity measured at a shear rate of 0.01 s−1 following the test method described herein. Medium shear viscosity is meant as the viscosity measured at a shear rate of 0.1 s−1. High shear viscosity is meant as the viscosity measured at a shear rate of 10 s−1.

The low, medium and high shear viscosities are determined using an AR G2 rheometer from TA instruments using a steel spindle at 40 mm diameter and a gap size of 500 μm. The low shear viscosity at 0.01 s−1, the medium shear viscosity at 0.1 s−1 and the high shear viscosity at 10 s−1 can be obtained from a logarithmic shear rate sweep at 20° C. The procedure consists of three steps including a pre-conditioning, a peak hold step at 0.01 s−1 and a flow ramp up from 0.01 s−1 to 100 s−1. The pre-conditioning step consists of a pre-shear at 10 s−1 for 30 s−1. The peak hold step at 0.01 s−1 follows immediately, taking a sample point every 10 s. The step reaches equilibrium if the viscosity of eight consecutive sample points is within a 2% tolerance. The flow ramp up follows immediately and consists in shearing the sample at increasing shear rates in steady state flow mode from 0.01 to 100 s−1, for 5 points per decade on a logarithmic scale, allowing measurements to stabilize for a period of from 2 s for up to 20 s with a tolerance of 2%. The logarithmic plot of the viscosity vs. shear rate of the last step is used to determine the low shear viscosity at 0.01 s−1, the medium shear viscosity at 0.1 s−1 and the high shear viscosity at 10 s−1.

Preferably, the surfactant system comprises at least 50%, more preferably at least 60% and especially at least 70% by weight thereof of the alkoxylated anionic surfactant. Detergents in which the surfactant system comprises at least 50% by weight thereof of the alkoxylated anionic surfactant provide very good cleaning and sudsing. Preferably, the alkoxylated anionic surfactant comprises a sulphate surfactant, preferably selected from the group consisting of alkyl sulphate, alkyl alkoxy sulphate and mixtures thereof. More preferably the alkoxylated ionic surfactant comprises an alkyl ethoxy sulphate. Detergents comprising mixtures of alkyl sulphate and alkyl alkoxy sulphate, in particular, alkyl ethoxy sulphate provide very good cleaning and sudsing, in particular when they are used as hand dishwashing detergents.

Preferably, the alkoxylated anionic surfactant comprises at least 50%, more preferably at least 60% and specially at least 70% by weight thereof of a sulphate surfactant. This again contributes to a good cleaning and sudsing.

Preferably, the alkoxylated anionic surfactant is a branched anionic surfactant having a level of branching of from about 5% to about 40%%, more preferably from about 10% to about 35% and more preferably from about 20% to about 30%. This level of branching also contributes to better dissolution and suds lasting. It also contributes to the stability of the detergent at low temperature.

Preferably the detergent of the invention comprises an amphoteric surfactant. More preferably the alkoxylated anionic and amphoteric surfactants are present in a weight ratio of from about 1:1 to about 8.5:1. Detergents having this ratio present good dissolution and suds performance, even faster dissolution and suds formation is achieved at a ratio of from about 1.5:1 to about 5:1, and even faster when the ratio is from about 2.5:1 to about 4.5:1. Fast dissolution is an important feature as it enables fast suds generation and enhanced cleaning, especially in the case of hand dishwashing detergents that are dosed directly onto a sponge and run under the tap, instead of dosing the detergent into a sink full of water.

Preferably the amphoteric surfactant comprises an amine oxide surfactant. Specially preferred in terms of cleaning and environmental profile are detergents in which the alkoxylated anionic surfactant comprises a mixture of alkyl sulphate and alkyl ethoxy sulphate and the amphoteric surfactant comprises an amine oxide surfactant. More preferably the amine oxide is an alkyl dimethyl amine oxide.

Preferably, the detergent of the invention comprises a non-ionic surfactant.

The liquid detergent of the invention is preferably aqueous, i.e., the main solvent is water. The detergent comprises from about 60 to about 95% by weight thereof of water. The surfactant system would act as an "internal structurant". By "internal structurant" is meant that the surfactant system would modify the rheology of the solvent to give rise to the detergent of the invention, with the claimed rheological properties. For the purpose of this invention "internal structurant" is a detergent component that can alter the rheology of the detergent but which it has an active detergent role. For example, the surfactant system would be considered an "internal structurant" because its primary role is to provide cleaning and at the same time confers the detergent an specific rheological properties.

The viscosity of the detergent can be adjusted by using a viscosity modifier. The viscosity modifier is preferably selected from the group consisting of electrolytes, organic solvents and mixtures thereof. A preferred electrolyte for use herein is sodium chloride.

The detergent of the invention is preferably free of external structurant, this contributes to the cost effectiveness and easiness of manufacture. By "external structurant" is herein meant a material which has as its primary function that of providing rheological alteration of the liquid matrix to give rise to a detergent having a medium to high viscosity ratio above 2. Generally, an external structurant will not, in and of itself, provide any significant cleaning. An external structurant is thus distinct from an internal structurant which may also alter matrix rheology but which has been incorporated into the liquid product for some additional primary purpose. Thus, for example, an internal structurant would be the surfactant system which can serve to alter rheological properties of the liquid detergent, but which have been added to the product primarily to act as cleaning ingredient.

According to another aspect of the invention, there is provided a method of washing dishes by hand using the detergent of the invention.

DETAILED DESCRIPTION OF THE INVENTION

The present invention envisages a liquid detergent comprising a surfactant system comprising an alkoxylated anionic surfactant. The liquid detergent is a viscous product at rest and under pouring conditions.

The Liquid Detergent

The liquid detergent is suitable for hand dishwashing, heavy duty laundry, hard surface cleaning, etc. Preferably the liquid detergent is a hand dishwashing detergent. It typically contains from 60% to 95%, preferably from 65% to 90%, more preferably from 70% to 85% by weight of a liquid carrier in which the other essential and optional components are dissolved, dispersed or suspended. One preferred component of the liquid carrier is water.

Preferably the pH of the detergent is adjusted to between 3 and 14, more preferably between 4 and 13, more preferably between 6 and 12 and most preferably between 8 and 10. The pH of the detergent can be adjusted using pH modifying ingredients known in the art.

Surfactant System

The detergent of the invention comprises from about 5% to about 20%, preferably from about 8% to about 18% by weight thereof of a surfactant system. The surfactant system comprises an alkoxylated anionic surfactant. The system can optionally comprise an amphoteric, non-ionic, cationic surfactant and mixtures thereof.

Suitable surfactants for use herein include anionic, amphoteric, non-ionic, cationic and mixtures thereof Anionic Surfactant The alkoxylated anionic surfactant of the detergent of the invention can be obtained by alkolxylation of conventional anionic surfactants. Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound. Usually, the hydrophobic group will comprise a C 8-C 22 alkyl, or acyl group. Such surfactants are employed in the form of water-soluble salts and the salt-forming cation usually is selected from sodium, potassium, ammonium, magnesium and mono-, di- or tri-C 2-C 3 alkanolammonium, with the sodium, cation being the usual one chosen.

The alkoxylated anionic surfactant can be a single surfactant but usually it is a mixture of anionic surfactants.

Preferably the alkoxylated anionic surfactant comprises a sulphate surfactant, more preferably a sulphate surfactant selected from the group consisting of alkyl sulphate, alkyl alkoxy sulphate and mixtures thereof. Preferred alkyl alkoxy sulphates for use herein are alkyl ethoxy sulphates.

The anionic surfactant is alkoxylated, more preferably, the alkoxylated anionic surfactant has an alkoxylation degree of from about 0.2 to about 1.75, even more preferably from about 0.3 to about 1.60, even more preferably from about 0.4 to about 1.50 and especially from about 0.4 to about 1.0. Preferably, the alkoxy group is ethoxy. When the anionic surfactant is a mixture of surfactants, the alkoxylation degree is the weight average alkoxylation degree of all the components of the mixture (weight average alkoxylation degree). In the weight average alkoxylation degree calculation the weight of anionic surfactant components not having alkoxylated groups should also be included.

$$\text{Weight average alkoxylation degree}=(x1*\text{alkoxylation degree of surfactant 1}+x2*\text{alkoxylation degree of surfactant 2}+\ldots)/(x1+x2+\ldots)$$

wherein x1, x2, . . . are the weights in grams of each anionic surfactant of the mixture and alkoxylation degree is the number of alkoxy groups in each anionic surfactant.

Preferably the alkoxylated anionic surfactant to be used in the detergent of the present invention is a branched anionic surfactant having a level of branching of from about 5% to about 40%, preferably from about 10% to about 35% and more preferably from about 20% to about 30%. Preferably, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the anionic surfactant used in the detergent of the invention. Most preferably the branched anionic surfactant is selected from alkyl sulphates, alkyl ethoxy sulphates, and mixtures thereof.

The branched anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

$$\text{Weight average of branching (\%)}=[(x1*\text{wt \% branched alcohol 1 in alcohol 1}+x2*\text{wt \% branched alcohol 2 in alcohol 2}+\ldots)/(x1+x2+\ldots)]*100$$

wherein x1, x2, . . . are the weight in grams of each alcohol in the total alcohol mixture of the alcohols which were used as starting material for the anionic surfactant for the detergent of the invention. In the weight average branching degree calculation the weight of anionic surfactant components not having branched groups should also be included.

Preferably, the surfactant system comprises at least 50%, more preferably at least 60% and preferably at least 70% of alkoxylated anionic surfactant by weight of the surfactant system, more preferably the anionic surfactant comprises more than 50% by weight thereof of an alkyl ethoxylated sulphate having an ethoxylation degree of from about 0.2 to about 1.70 and preferably a level of branching of from about 5% to about 40%.

Sulphate Surfactants

Suitable sulphate surfactants for use herein include water-soluble salts of C8-C18 alkyl or hydroxyalkyl, sulphate and/or ether sulfate. Suitable counterions include alkali metal cation or ammonium or substituted ammonium, but preferably sodium.

The sulphate surfactants may be selected from C8-C18 primary, branched chain and random alkyl sulphates (AS); C8-C18 secondary (2,3) alkyl sulphates; C8-C18 alkyl alkoxy sulphates (AExS) wherein preferably x is from 1-30 in which the alkoxy group could be selected from ethoxy, propoxy, butoxy or even higher alkoxy groups and mixtures thereof.

Alkyl sulfates and alkyl alkoxy sulfates are commercially available with a variety of chain lengths, ethoxylation and branching degrees, and are those known by persons skilled in the art, including but are not limited to those based on Neodol alcohols ex the Shell company, Lial-Isalchem and Safol ex the Sasol company, natural alcohols ex The Procter & Gamble Chemicals company.

Preferably, the alkoxylated anionic surfactant comprises at least 50%, more preferably at least 60% and especially at least 70% of a sulphate surfactant by weight of the anionic surfactant. Especially preferred detergents from a cleaning view point art those in which the alkoxylated anionic surfactant comprises more than 50%, more preferably at least 60% and especially at least 70% by weight thereof of sulphate surfactant and the sulphate surfactant is selected from the group consisting of alkyl sulphate, alkyl ethoxy sulphates and mixtures thereof. Even more preferred are those in which the alkoxylated anionic surfactant has a degree of ethoxylation of from about 0.2 to about 1.75, more preferably from about 0.3 to about 1.6, even more preferably from about 0.4 to about 1.5, and especially from about 0.4 to about 1 and even more preferably when the alkoxylated anionic surfactant has a level of branching of from about 5% to about 40%, more preferably from about 10% to 35%, most preferably from about 20% to about 30%.

Sulphonate Surfactants

Suitable sulphonate surfactants for use herein include water-soluble salts of C8-C18 alkyl or hydroxyalkyl sulphonates; C11-C18 alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also include the alkyl glyceryl sulphonate surfactants.

Amphoteric Surfactant

Suitable amphoteric surfactants include amine oxides and betaines. Especially preferred for use herein being amine oxides. Preferably the surfactant system comprises more than 1% and less than 50% of amphoteric surfactant by weight of the surfactant system.

Preferred amine oxides are alkyl dimethyl amine oxide or alkyl amido propyl dimethyl amine oxide, more preferably alkyl dimethyl amine oxide and especially coco dimethyl amine oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3) O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

Other suitable surfactants include betaines such alkyl betaines, alkylamidobetaine, amidazoliniumbetaine, sulfobetaine (INCI Sultaines) as well as the Phosphobetaine and preferably meets formula I:

$$R1[CO—X(CH2)nJx\text{-}N+(R2)(R3)\text{-}(CH2)m\text{-}[CH(OH)—CH2Jy\text{-}Y— \quad \text{(I) wherein}$$

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, O or S, n a number from 1 to 10, preferably 2 to 5, in particular 3, x 0 or 1, preferably 1, R2, R3 are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, OPO(OR5)O or P(O)(OR5)O, whereby R5 is a hydrogen atom H or a C1-4 alkyl residue.

Preferred betaines are the alkyl betaines of the formula (Ia), the alkyl amido betaine of the formula (Ib), the Sulfo betaines of the formula (Ic) and the Amido sulfobetaine of the formula (Id);

R1-N+P(CH3)2-CH2COO— (Ia)

R1-CO—NH(CH2)3-N+(CH3)2-CH2COO— (Ib)

R1-N+(CH3)2-CH2CH(OH)CH2SO3- (Ic)

R1-CO—NH—(CH2)3-N+(CH3)2-CH2CH(OH) CH2SO3- (Id)

in which R11 as the same meaning as in formula I. Particularly preferred betaines are the Carbobetaine [wherein Y—═COO—], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

Preferably the betain is a cocoamidopropyl betain, in particular cocoamidopropylbetain.

Nonionic Surfactants

The surfactant system of the detergent of the invention optionally comprises a non-ionic surfactant, preferably an alcohol alkoxylated. Non-ionic surfactant, when present, is comprised in a typical amount of from 0.1% to 10%, preferably 0.2% to 5%, most preferably 0.5% to 3% by weight of the surfactant system. Suitable non-ionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol.

Also suitable are alkylpolyglycosides having the formula $R^2O(C_nH_{2n}O)_t(\text{glycosyl})_x$ (formula (III)), wherein $R^2$ of formula (III) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose. Also suitable are alkylglycerol ethers and sorbitan esters.

Also suitable are fatty acid amide surfactants having the formula (IV):

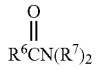

(IV)

wherein $R^6$ of formula (IV) is an alkyl group containing from 7 to 21, preferably from 9 to 17, carbon atoms and each $R^7$ of formula (IV) is selected from the group consisting of hydrogen, $C_1$-$C_4$ alkyl, $C_1$-$C_4$ hydroxyalkyl, and $—(C_2H_4O)_xH$ where x of formula (IV) varies from 1 to 3. Preferred amides are $C_8$-$C_{20}$ ammonia amides, monoethanolamides, diethanolamides, and isopropanolamides.

Cationic Surfactants

Cationic surfactants, when present in the liquid detergent, are present in an effective amount, more preferably from 0.01% to 10%, more preferably 0.05% to 5%, most preferably 0.1% to 3% by weight of the liquid detergent composition. Suitable cationic surfactants include quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Other preferred cationic surfactants include alkyl benzalkonium halides and derivatives thereof, such as those available from Lonza under the BARQUAT and BARDAC tradenames. Another preferred cationic surfactant is an $C_6$-$C_{18}$ alkyl or alkenyl ester of a quaternary ammonium alcohol, such as quaternary chlorine esters. More preferably, the cationic surfactants have the formula (V):

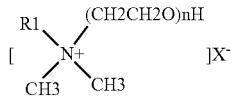

(V)

wherein R1 of formula (V) is $C_8$-$C_{18}$ hydrocarbyl and mixtures thereof, preferably, $C_{8-14}$ alkyl, more preferably, $C_8$, $C_{10}$ or $C_{12}$ alkyl, and X of formula (V) is an anion, preferably, chloride or bromide.

Viscosity Modifier

The detergent of the invention can optionally comprise a viscosity modifier. The purpose of the viscosity modifier is to achieve the desired viscosity in combination with the surfactant system. The low level of the surfactant system in the detergent might result in a product of lower or higher viscosity than desired, the viscosity can be increased or lowered by using a viscosity modifier.

Preferably, the viscosity modifier is selected from the group consisting of electrolytes, organic solvents, and mixtures thereof. The detergent according to the invention, preferably comprise at least one electrolyte.

Electrolytes are water-soluble organic and inorganic salts (other than surfactants), wherein the cation is chosen from alkali metals, alkaline earth metals, ammonium and mixture thereof and the anion is chosen from chloride, sulfate, phosphate, acetate, nitrate and mixtures thereof. Particularly useful are potassium, sodium and ammonium chloride.

The amount of electrolyte should be sufficient to modify the viscosity of the detergent. A useful amount of electrolyte in the detergent of the invention is from 0.1% to 10%, more preferably from 0.15% to 5%, even more preferably from 0.2% to 3%, particularly from 0.25% to 2% by weight of the detergent.

Useful organic solvents to be added, preferably in addition to electrolytes, as viscosity modifiers are C1-C5 alkyl alcohols having one to three hydroxyl groups, and the concentration of said solvents is chosen so as to achieve the viscosity target. Other suitable organic solvents include C4-14 ethers and diethers, glycols and polymeric glycols such as polyethyleneglycol and polypropyleneglycol, alkoxylated glycols, C6-C16 glycol ethers, alkoxylated aromatic alcohols, aromatic alcohols, aliphatic branched alcohols, alkoxylated aliphatic branched alcohols, alkoxylated linear C1-C5 alcohols, amines, C8-C14 alkyl and cycloalkyl hydrocarbons and halohydrocarbons, and mixtures thereof. Also suitable for use herein as organic solvent are hydrotropes include anionic-type hydrotropes, particularly sodium, potassium, and ammonium xylene sulfonate, sodium, potassium and ammonium toluene sulfonate, sodium potassium and ammonium cumene sulfonate, and mixtures thereof. Preferred solvents are ethanol, (poly)propylene glycol and or cumene, toluene or xylene sulphonate hydrotropes, most preferably ethanol, propyleneglycol, polypropyleneglycol, and mixtures thereof, preferably each in an amount of 1% to 7% by weight of the detergent. The weight ratio of the amount of surfactant system to viscosity modifier is preferably between 3 and 20.

External Structurant

Preferably the detergent is free of external structurant. By "free" is herein meant that the detergent comprises less than 0.01%, more preferably less than 0.001% by weight thereof of external structurant. External structurants include microfibrillated celluloses, non-polymeric, hydroxyl-containing materials generally characterized as crystalline, hydroxyl-containing fatty acids, fatty esters and fatty waxes, such as castor oil and castor oil derivatives. It also includes naturally derived and/or synthetic polymeric structurants such as polycarboxylates, polyacrylates, hydrophobically modified ethoxylated urethanes, alkali soluble emulsions, hydrophobically modified alkali soluble emulsions, hydrophobically modified non-ionic polyols, cross-linked polyvinylpyrrolidone, polysaccharide and polysaccharide derivative type. Polysaccharide derivatives typically used as structurants comprise polymeric gum materials. Such gums include pectine, alginate, arabinogalactan (gum Arabic), carrageenan, gellan gum, xanthan gum and guar gum. Other classes of external structurants include structuring clays, amidogellants and fatty esters such as isopropyl myristate, isopropyl palmitate and isopropyl isostearate.

More preferably the detergent is free from crystalline external structurants such as non-polymeric hydroxyl-containing materials, microfibrillated celluloses and non-crystalline external structurants such as polymeric structurants selected from the group consisting of polyacrylates, polysaccharides, polysaccharide derivatives and mixtures thereof.

Optional Detergent Components

The detergent herein can further comprise a number of other optional ingredients such as builders, chelants, conditioning polymers, cleaning polymers, surface modifying polymers, soil flocculating polymers, emmolients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, organic and inorganic cations such as alkaline earth metals such as Ca/Mg-ions and diamines, suds suppressors/stabilizers/boosters, antibacterial agents, preservatives and pH adjusters and buffering means.

Method of Use

The detergent of the invention is especially suitable for use as hand dishwashing detergent. Due to its dissolution profile it is extremely suitable for use directly on a sponge in its neat form or as a concentrated pre-solution to wash dishes. Due to its suds profile it is also quite advantageous when used in a full sink of water to wash dishes.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

EXAMPLES

The following simplified detergents were formulated through simple mixing of active raw materials. Detergents within the scope of the invention, having a pouring viscosity of 4000 mPa s are showed in Table 1. Detergents outside the scope of the invention (reference), having a pouring viscosity of 2000 mPa s are showed in Table 2. The concentration of each material is given on a 100% active weight basis. The detergents contain 15% by weight thereof of surfactant system. The surfactant system comprises alkyl ethoxy sulphate and amino oxide surfactant. Alkyl ethoxylated sulphate with different degrees of ethoxylation (EO) are tested. The pouring viscosity has been measured using a Brookfield DV-II+ Pro viscometer (20° C., spindle 31, RPM: 0.6 for ~4000 mPa s—RPM: 10 for ~2000 mPa s). The medium and high shear viscosities have been measured following the test method described herein.

TABLE 1

| | Pouring viscosity target: 4000 mPa s<br>Surfactant system (AES:AO - 4.4:1-ratio) = 15% | | |
|---|---|---|---|
| AES EO | 0.19 | 0.61 | 1.65 |
| NaCl | 0.80% | 0.90% | 0.85% |
| Ethanol | 1.32% | 1.68% | 0.47% |
| NaOH | | | |
| HCl | 0.26% | 0.24% | 0.24% |

TABLE 1-continued

| | Pouring viscosity target: 4000 mPa s Surfactant system (AES:AO - 4.4:1-ratio) = 15% | | |
|---|---|---|---|
| AES EO | 0.19 | 0.61 | 1.65 |
| Water | To balance | To balance | To balance |
| pH (10% aqueous solution) | 9.07 | 9.08 | 8.99 |
| Pouring Viscosity | 4304 mPa s | 4030 mPa s | 4005 mPa s |
| Medium shear viscosity | 6680 mPa s | 4514 mPa s | 5164 mPa s |
| High shear viscosity | 6526 mPa s | 4489 mPa s | 4920 mPa s |

TABLE 2

| | Pouring viscosity target: 2000 mPa s Surfactant system (AES:AO - 4.4:1-ratio) = 15% | | |
|---|---|---|---|
| AES EO | 0.19 | 0.61 | 1.65 |
| NaCl | 0.80% | 0.90% | 0.80% |
| Ethanol | 2.26% | 2.70% | 1.23% |
| NaOH | | | |
| HCl | 0.26% | 0.25% | 0.24% |
| Water | To balance | To balance | To balance |
| pH (10% aqueous solution) | 9.07 | 8.98 | 8.99 |
| Pouring Viscosity | 2030 mPa s | 1890 mPa s | 2050 mPa s |
| Medium shear viscosity | 2420 mPa s | 2157 mPa s | 2488 mPa s |
| High shear viscosity | 2387 mPa s | 2103 mPa s | 2455 mPa s |

AES: Alkyl Ethoxy Sulfate—AES branching=25%, prepared through mixing Alkyl Sulfates and Alkyl Ethoxy Sulfates based on Lial 123A (ex Sasol), Natural AE3 (ex PGC), Shell A (ex Shell) and Natural A (ex PGC) alcohols.

AO: C12-14 dimethyl amine oxide

Dissolution profiles of the respective detergents were determined according to the following protocol:

A dynamic dissolution test is conducted to cross-compare the relative dissolution kinetics of the three reference detergents (Table 2) and the three detergents in accordance with the invention (Table 1). This method allows determining the dissolution profile over time using conductivity monitoring, under fixed test conditions.

4000 ml of demineralized water at 20° C. (+/−0.5° C.) is added to a 5000 ml glass beaker (diameter~18 cm, height~25.5 cm) and mixed with an overhead mixer (ex IKA Labortechnik—ikaa2684700 reference ex Merck catalogue 2002) using a 4 blades mixer (ex IKA Labortechnik: diameter=10 cm, blades inclination=45°) with set agitation when actioned at 90 RPM (±1). The mixer is set at a 5 cm depth in the middle of the stirring solution. The conductivity probe (TetraCon 325 ex WTW) is set at 4 cm depth in the washing solution at 1 cm from the side wall of the glass beaker.

5 ml of detergent according to the invention or of the reference detergent is added gently at the bottom of the beaker. The overhead stirrer and conductivity measurements are started straight after the detergent has been added.

The conductivity is measured every 5 seconds and the experiment stops when the conductivity measurement has remained constant for at least 20 seconds. The dissolution time recorded is the number of seconds at which 70% of the final conductivity value has been achieved.

The experiment is repeated three times and the average value is reported. 150 seconds has been proven through consumer research to be the acceptable dissolution limit for non-structured liquids.

The dissolution data of the respective detergents are summarized below. It can be seen that when increasing the product viscosity the dissolution profile gets more challenged, especially in the cases in which the ethoxylated surfactant has a lower ethoxyltion degree (0.19) where the consumer acceptable threshold is passed.

| AES average | 4000 mPa s | | |
|---|---|---|---|
| EO | 0.19 | 0.61 | 1.65 |
| Time (s) at 70% | 179 | 138 | 113 |

| AES average | 2000 mPa s | | |
|---|---|---|---|
| EO | 0.19 | 0.61 | 1.65 |
| Time (s) at 70% | 126 | 93 | 78 |

The detergents have also been stored at 0° C. to assess the physical stability profile when exposed to lower temperature. The % of failure (% F) is defined as the crystallized volume fraction versus the total volume fraction and is visually estimated. From the table it can be seen that lower ethoxylation degrees have a more stressed low temperature physical stability profile.

| | 4000 mPa s | | |
|---|---|---|---|
| | EO = 0.19 | EO = 0.61 | EO = 1.65 |
| Day 4 | 100% F | 1% F | 0% F |
| Day 6 | 100% F | 2% F | 0% F |
| Day 8 | 100% F | 2% F | 0% F |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. A liquid detergent comprising:

a) from about 5% to about 20% by weight thereof of a surfactant system wherein the surfactant system comprises:

i) an alkoxylated anionic surfactant having and alkoxylation degree of from 0.20 to 1.75 and a level of branching from about 5% to about 40%; and ii) an amine oxide surfactant, wherein the alkoxylated anionic to amine oxide surfactant weight ratio is from about 1:1 to about 8.5:1;

b) a viscosity modifier selected from the group consisting of electrolytes, organic solvents and mixtures thereof;

wherein the detergent is free of an external structurant selected from the group consisting of non-polymeric hydroxyl-containing materials, microfibrillated celluloses, polyacrylates, polysaccharides, polysaccharide derivatives and mixtures thereof, and wherein the detergent at 20° C. has a pouring viscosity of from about 2500 mPa s to about 6000 mPa s and a ratio of medium to high shear viscosity of from about 2 to about 1.

2. A detergent according to claim 1, wherein the surfactant system comprises at least 50% by weight thereof of alkoxylated anionic surfactant.

3. A detergent according to claim 1, wherein the alkoxylated anionic surfactant comprises a sulphate surfactant.

4. A detergent according to claim 1, wherein the alkoxylated anionic surfactant comprises at least 50% by weight thereof of the alkoxylated anionic sulphate surfactant.

5. A detergent according to claim 1, wherein the alkoxylated anionic surfactant has an alkoxylation degree of from about 0.3 to about 1.60.

6. A detergent according to claim 1, wherein the surfactant system comprises a non-ionic surfactant.

7. A detergent according to claim 1 having a pouring viscosity of from about 3000 mPa s to about 5000 mPa s.

8. A detergent according to claim 1 having a ratio of low to high shear viscosity of from about 2 to about 1.

9. A detergent according to claim 1, wherein the electrolyte is sodium chloride.

10. A detergent according to claim 1, wherein the detergent is a hand dishwashing detergent.

11. A method of washing dishes using a detergent according to claim 1.

12. A liquid detergent comprising:

a) from about 5% to about 20% by weight thereof of a surfactant system wherein the surfactant system comprises an alkoxylated anionic surfactant having an alkoxylation degree of from 0.20 to 1.75;

b) about 1% to about 7% by weight of ethanol;

c) about 0.25% to about 2% by weight of an electrolyte;

wherein the detergent is free of an external structurant selected from the group consisting of non-polymeric hydroxyl-containing materials, microfibrillated celluloses, polyacrylates, polysaccharides, polysaccharide derivatives and mixtures thereof, and wherein the detergent at 20° C. has a pouring viscosity of about 4000 mPas and a ratio of medium to high shear viscosity of from about 2 to about 1.

* * * * *